US005821447A

United States Patent [19]

Reams et al.

[11] Patent Number: 5,821,447

[45] Date of Patent: Oct. 13, 1998

[54] SAFETY AND ARMING DEVICE

[75] Inventors: William H. Reams, Keedysville; Douglas M. Hinely, Rockville, both of Md.; Brian L. Will, Fredericksburg, Va.; Louis J. Montesi, Laurel; Gerald R. Laib, Olney, both of Md.

[73] Assignee: The United States of America as represented by the Secretary of the Navy, Washington, D.C.

[21] Appl. No.: 520,976

[22] Filed: Aug. 24, 1995

[51] Int. Cl.[6] ..... F42B 22/44

[52] U.S. Cl. ..... 102/223; 102/229; 102/420; 102/406; 89/1.55

[58] Field of Search ..... 102/223, 224, 102/228, 229, 254, 255, 256, 257, 390, 391, 392, 420, 419, 416, 411, 406, 263; 89/1.55

[56] References Cited

U.S. PATENT DOCUMENTS

| | | | |
|---|---|---|---|
| H492 | 7/1988 | Kong et al. | 102/229 |
| 3,165,059 | 1/1965 | Saunders | 102/225 |
| 3,710,722 | 1/1973 | Demas et al. | 102/226 |
| 3,842,743 | 10/1974 | Zittle | 102/229 |
| 3,994,231 | 11/1976 | Rudeen et al. | 102/228 |
| 4,341,159 | 7/1982 | Edminster | 102/228 |
| 4,369,709 | 1/1983 | Backstein et al. | 102/420 |
| 4,380,197 | 4/1983 | Eaton | 102/228 |
| 5,005,482 | 4/1991 | Reams | 102/420 |
| 5,016,532 | 5/1991 | Edminster | 102/254 |

*Primary Examiner*—Charles T. Jordan
*Assistant Examiner*—Christopher K. Montgomery
*Attorney, Agent, or Firm*—John Forrest; Jacob Shuster

[57] ABSTRACT

A safety and arming device interconnecting a bomb with a target detector insures safe mine laying deployment thereof through a detonation explosive train that is armed in delayed response to payout of a lanyard under enablement control exercised by a hydrodynamic piston in response to water impact during such deployment.

12 Claims, 3 Drawing Sheets

FIG. 1
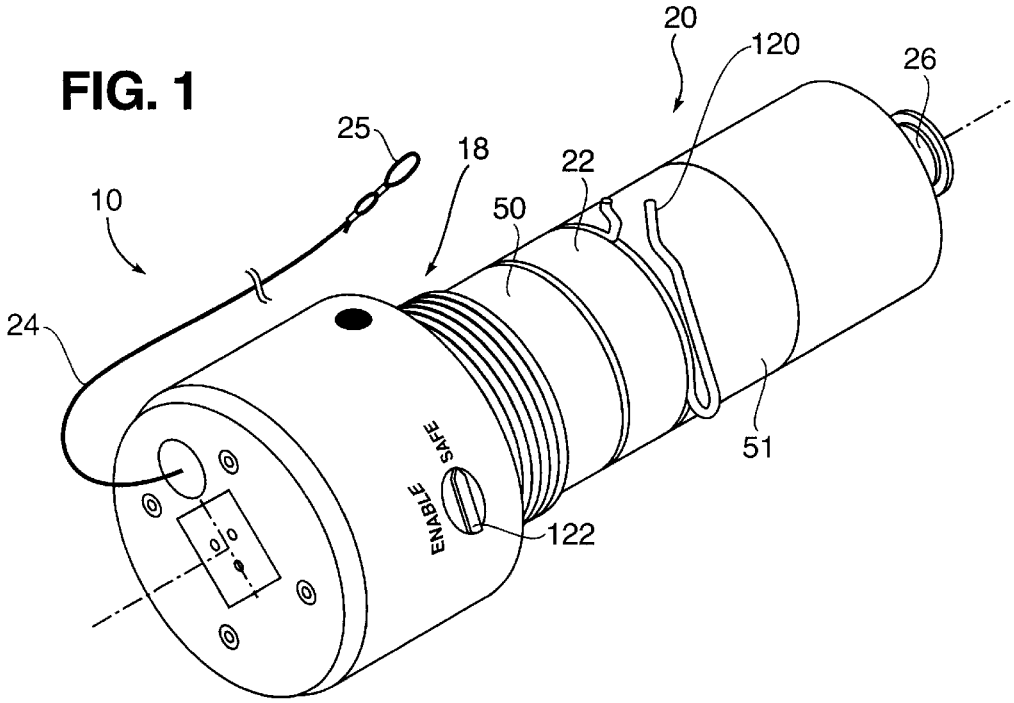
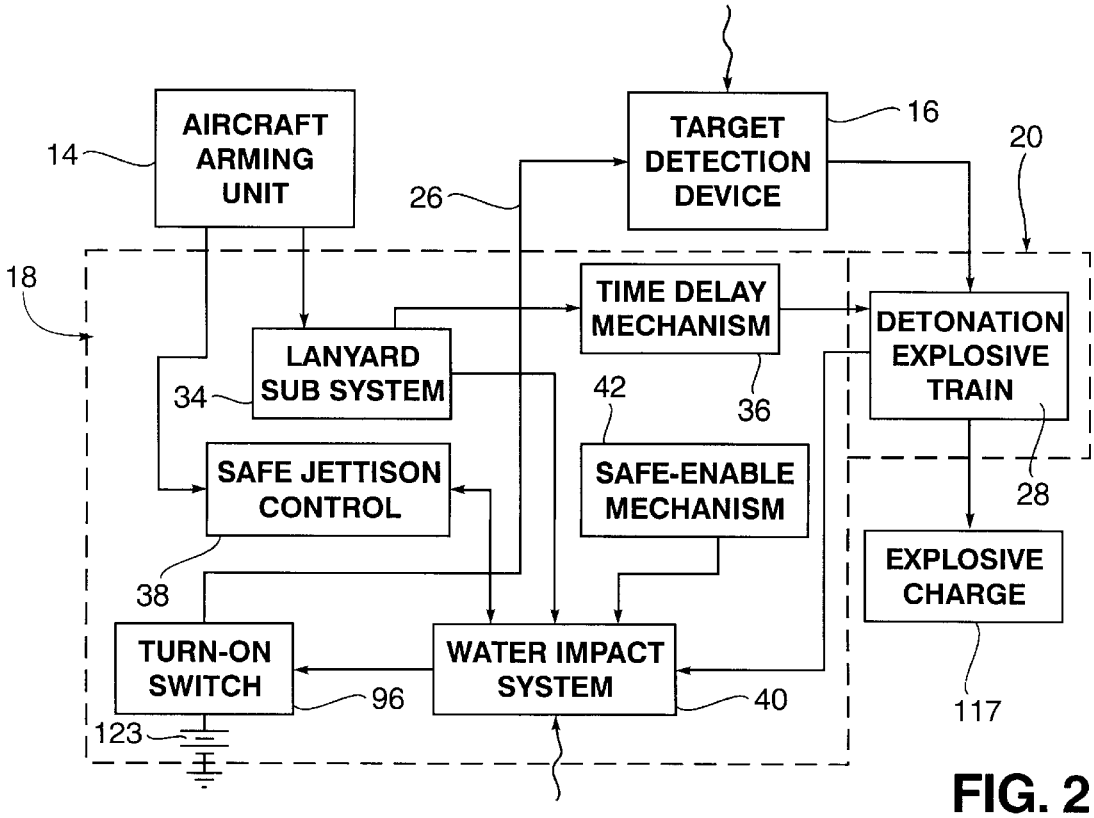
FIG. 2

SAFETY AND ARMING DEVICE

BACKGROUND OF THE INVENTION

The present invention relates generally to the fail-safe arming of explosive weapons, and more particularly to the arming of mines or the like deployed into water from an aircraft.

The provision of safety and arming devices for aircraft delivered explosive weapons, is already generally known in the art. Heretofore, such safety and arming devices were operated in response to impact so as to restrict aircraft delivery speed and altitude as a safety measure. Also, aircraft launch conditions and deployment requirements imposed by prior arming devices, restricted delivery speed and altitude and imposed water depth requirements on underwater mine laying operations.

It is therefore an important object of the present invention to provide a safety and arming device which improves underwater explosive weapon deployment by aircraft delivery, with respect to safety, reliability and imposition of operational limits.

SUMMARY OF THE INVENTION

In accordance with the present invention, a safety and arming device is installed in an aircraft delivery envelope, such as the casing for a bomb and target detector. A lanyard pays out from a winding spool within the safety and arming device to store energy in a clock spring during deployment. Water impact is detected through a hydrodynamic piston during deployment so as to avoid arming in response to dry land impact. The water and dry land environments involved in use of the safety and arming device accounts for a reduction in altitude and an decrease in flight speed from limits heretofore imposed on arming operations. Explosive safety and reliability is also improved during arming operations by use of a detonator that is both electrically shorted and held in out-of-line relation to an explosive train by a time delay driven rotor until fail-safe completion of an arming cycle is achieved.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein:

FIG. 1 is a perspective view of a safety and arming device constructed in accordance with one embodiment of the invention;

FIG. 2 is a block diagram schematically illustrating the safety and arming device in functional relation to associated aircraft delivery components;

Figure 3:
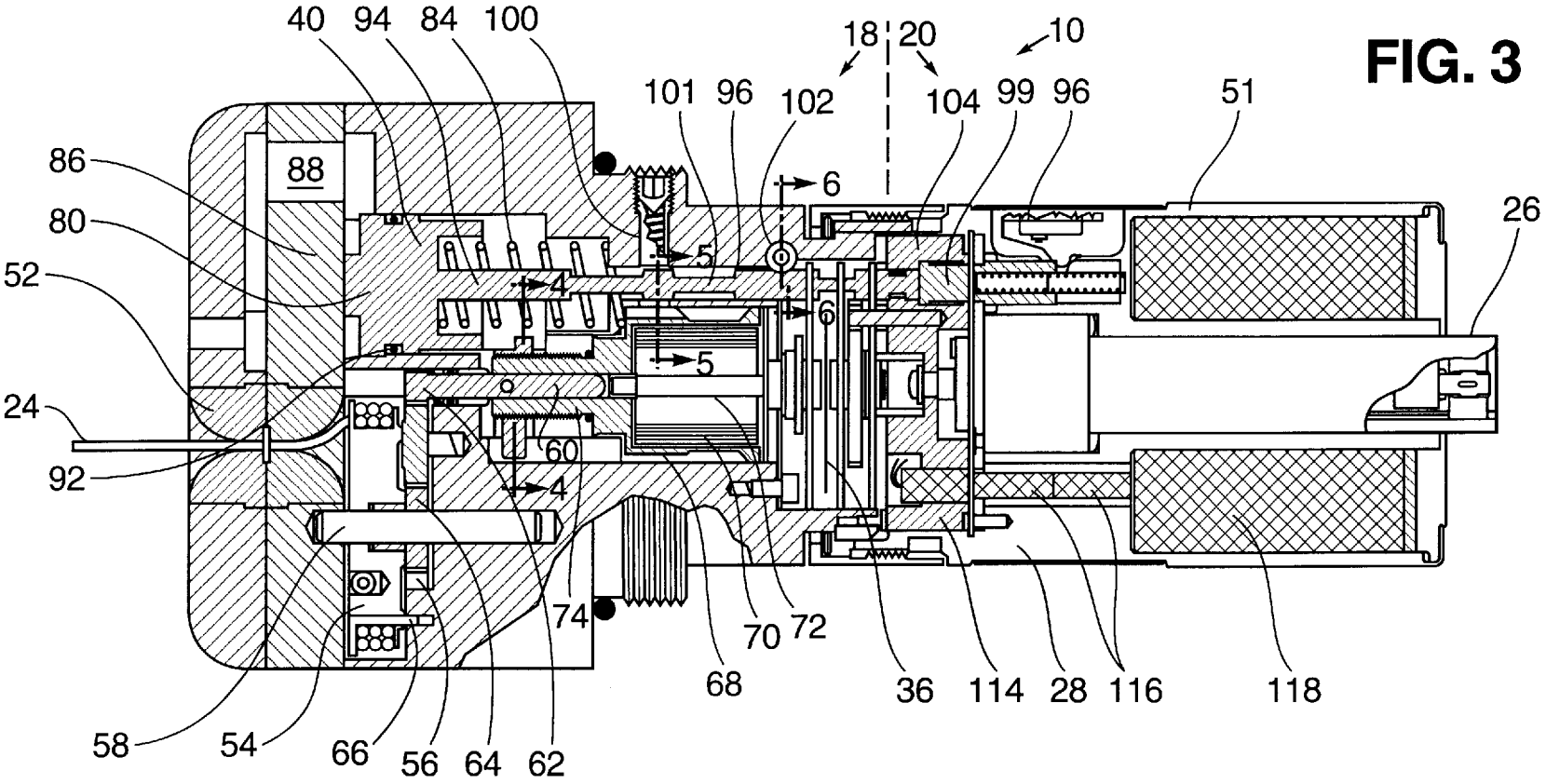
FIG. 3 is a side section view of the safety arming device shown in FIG. 1.
Figure 4:
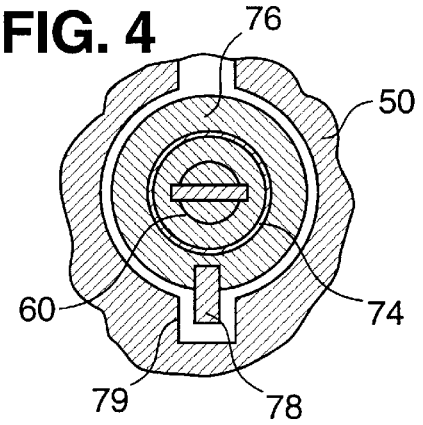
Figure 5:
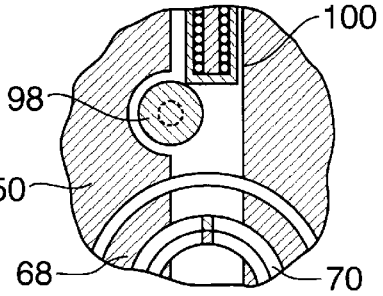
Figure 6:
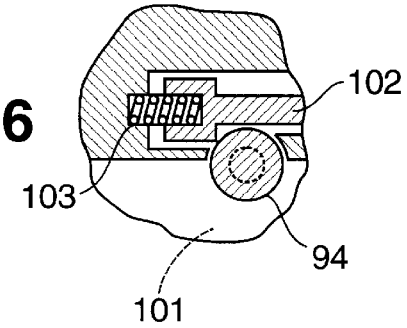
Figure 7:
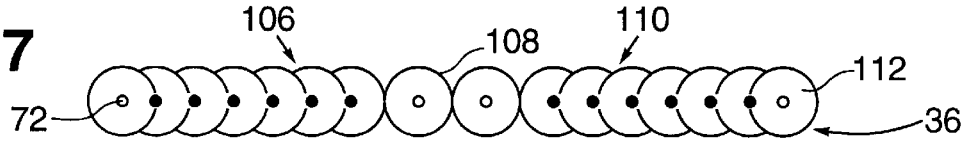

FIGS. 4, 5 and 6 are partial transverse section views taken substantially through planes indicated by section lines 4—4, 5—5 and 6—6 in FIG. 3; and FIG. 7 is a schematic view of the time delay drive mechanism depicted in FIGS. 2 and 3.

DETAILED DESCRIPTION OF PREFERRED EMBODIMENT

Referring now to the drawing in detail, FIG. 1 illustrates a safety and arming device, generally referred to by reference numeral 10, which is to be utilized for improved delivery of naval weapon mines in accordance with one embodiment of the invention. The device 10 is accordingly associated with a launch platform on a high speed, low altitude flying aircraft from which a bomb is deployed as an underwater mine. Such bomb is associated with a aircraft arming unit 14 and a target detection device 16, as diagrammed in FIG. 2 and generally known in the naval mine laying art. Thus, the device 10 is adapted to be installed in the nose fuse well of the bomb casing as an aircraft delivery envelope, also having a tail fuse well within which the target detection device 16 is installed. The device 10 includes a safety section 18 and an arming section 20 interconnected therewith by means of a joint ring 22 as shown in FIG. 1. The safety section 18 is physically connected to the aircraft arming unit 14 by a lanyard 24 and swivel 25 of calibrated strength, while a bomb connector 26 projects from the arming section 20, as also shown in FIG. 1, for communication with the target detector device 16. The operational connections between the device 10 and the target detection device 16 are diagrammed in FIG. 2.

As depicted in FIG. 2, a detonation explosive train 28 is provided within the arming section 20 of device 10 to establish an explosive path to the bomb, such path being selectively rendered discontinuous when device 10 is in a "safe" condition and the explosive train maintained electrically shorted. The target detection device 16 is also electrically turned on as hereinafter explained. When a target is thereafter sensed by the target detection device 16, it sends an electrical signal through a bomb fuse cable from and the bomb connector 26 to the explosive train 28 to achieve detonation. The lanyard 24 connected to the aircraft arming unit 14 through swivel 25 extends into the lanyard subsystem 34 of the safety section 18, from which lanyard movement is transferred by a time delay mechanism 36 to the explosive train 28 under safety payout restrictions imposed by safe jettison controls 38 through which a water impact subsystem 40 is also enabled. Subsystem 40 detects entry of the delivery envelope carrying device 10 into the water to provide an output applied to the safe jettison controls 38 for payout control of the subsystem 34 of device 10 connected to the explosive train 28 through time-delay mechanism 36 for regulating arming. A safe-enable mechanism 42 is connected to subsystem 40 as also diagrammed in FIG. 2.

The aforementioned "safe" condition of the device 10 is maintained by out-of-line positioning of the detonation explosive train 28 of arming section 20 during storage, handling and transportation of device 10 in its delivery envelope installation. Only after environmental conditions unique to weapon deployment are sensed in the safety section 18 of device 10, is it switched to the "armed" condition. Such environmental conditions include aircraft launch reflected by deployment of the lanyard 24, hydrodynamic pressure reflecting water entry sensed by the water impact subsystem 40 as hereinafter described and a time delay imposed by the time delay mechanism 36 for fail-safe operational control. Before the delivery envelope enclosing the device 10 is dropped from an aircraft, the lanyard 24 is held retracted within the safety section 18 under a force of 40 pounds for example, exceeding the pull-out force of the arming unit 14 of the aircraft imposed by its deenergized solenoid (not shown), to prevent initiation of any arming sequence. Such solenoid in the arming unit 14 is energized under selective control of the aircraft pilot to "arm" the device 10 before a mine laying operation is initiated, in which case the lanyard 24 will be pulled from the device 10 when its delivery envelope is dropped. The arming unit solenoid may remain deenergized if the delivery envelope is dropped without arming thereof, in which case the lanyard 24 is not extracted from device 10 as it falls from the aircraft. Upon ejection of the delivery envelope from the aircraft after arming, it continues to fall a short distance of 30 inches for example, during which the lanyard subsystem 34 stores energy transferred thereto by lanyard payout to enable the water impact subsystem 40 when deployment is subsequently completed. Further payout of the lanyard 24 is then prevented so that it separates from the arming unit 14 under a force of about 150 pounds established by calibration of swivel 25 connecting the lanyard to the arming unit.

During travel of the device 10 through the water in its delivery envelope, the hydrodynamic pressure exerted on the water impact subsystem 40 turns on the target detection device 16 as hereinafter explained while operation of the water impact subsystem 40 continues. Also, the detonation explosive train 28 is unlocked to permit operation thereof after an approximately 90 second time delay imposed by the time delay mechanism 36, as aforementioned. At the end of such time delay, electrical shorting of detonation is removed, electrical firing circuit connection is made and detonation path completed to establish the "armed" condition of device 10 after a momentary hydrodynamic pressure on the water impact subsystem 40 subsides. In such "armed" condition, a firing signal from the target detection device 16 within the deployed delivery envelope casing, is awaited.

Referring now to FIG. 3, the lanyard 24 extends into a cylindrical housing 50 of the safety section 18 through a bearing assembly 52 radially offset from the axis of housing 50. The lanyard 24 in the retracted storage position shown, is wound upon a spool 54 of the lanyard subsystem 34 aforementioned, which also includes a gear train having a drive gear 56 fixed to the spool 54 and rotatably mounted therewith in the housing 50 by shaft 58. The spool 54 is drivingly connected by the gear train to a driven shaft 60 having a pinion gear 62 at one axial end thereof in mesh with idler gear 64 also rotatably mounted in the housing and in mesh with the drive gear 56. A shear pin 66 constituting one of the safe jettison controls 38 extends from a radially outer portion of spool 54 into the housing to hold the spool fixed during storage of the lanyard 24 wound thereon. In response to the pull exerted on the lanyard by the arming unit 14 in excess of 40 pounds, the resulting torque applied to the spool 54 causes shear of the pin 66 to release the spool for rotational payout of the lanyard. Such rotational movement is transferred from spool 54 to shaft 60 by the gears 56, 64 and 62.

The shaft 60 is connected to a barrel 68 in the safety section 18 to which an energy storage clock spring 70 is fixed at its radially inner end to the delay drive mechanism 36 by an arbor 72 on which the barrel 68 is rotatably mounted. The rotation imparted to the barrel 68 through shaft 60 by the gearing 56, 64, 62 in response to lanyard payout, thus causes clock spring 70 to be wound within the barrel 68 for storage of mechanical energy therein. Such rotation of barrel 68 is also imparted by shaft 60 to a threaded tubular shaft 74 extending axially from the barrel 68 as shown in FIG. 3.

While the energy storing clock spring 70 is being wound within barrel 68, rotation of the threaded tubular shaft 74 causes axial displacement of a nut 76 threadedly mounted thereon, as more clearly seen in FIG. 4, to form another one of the safe jettison controls 38. A pin 78 projecting from nut 76 into an axial guide slot 79 formed in housing 50, limits its rotational displacement thereby enabling axial movement of nut 76 as the barrel rotates. A shoulder on barrel 68 limits such axial movement of the nut 76, to thereby enable the water impact subsystem 40 as hereinafter explained. In the axial limit position of the nut 76, corresponding to complete lanyard deployment and full winding of clock spring 70, further rotation of the barrel 68 is stopped. Further payout of the lanyard 24 is thereby resisted by the barrel 68 with sufficient force so that when the tension in the lanyard exceeds about 150 pounds, the swivel 25 fails and the lanyard 24 is thus disconnected from the aircraft arming unit 14 with most of it retained within the device 10 to avoid the aircraft becoming unencumbered by the lanyard.

The water impact system 40 includes a hydrodynamic piston 80 slidably displaceable within an axial bore 82 formed in the housing 50. The piston 80 is biased by a calibrated spring 84 into abutment with a stop element 86 in the housing having a passage 88 through which fluid communication is established between the piston bore 82 on one axial side of piston 80 and an external water entry opening 90 in the housing as shown in FIG. 3. An o-ring seal 92 on the piston 80, isolates the piston spring 84 within bore 82 on the other axial side of piston 80. An elongated piston rod 94 extends from the piston 80 through a diametrically smaller bore 96 from the housing 50 into the arming section 20 of device 10. Accordingly, the pressure of water entering opening 90 is exerted through passage 88 on the piston 80 causing its displacement against the bias of spring 84 to detect the generation of a hydrodynamic pressure during travel of device 10 through water at a predetermined high velocity characteristic of the low altitude, high speed aircraft mine laying operation.

Initial axial displacement of the piston 80 of the water impact subsystem 40 toward its armed position, is limited to a short distance by its engagement with the nut 76 of the safe jettison controls 38, which also includes a lock-out release operated by means of a formation 98 on the piston rod 94 when displaced from the safe position shown in FIG. 3. In such safe position, the lock-out release formation 98 holds a spring-biased jettison detent 100 in its retracted position within the housing 50 as more clearly seen in FIG. 5. When released from its retracted position, the detent 100 engages and latches the barrel 68 to thereby prevent continued winding of the energy storing spring 70 after water entry is detected.

With continued reference to FIG. 3, the piston rod 94 extends from the housing 50 of the safety section 18 into the housing 51 of the arming section 20 to actuate the turn-on switch 96 by means of a plunger 99 in response to displacement of the piston 80 to its armed position. When actuated, the switch 96 electrically connects power supply 123 to the target detection device 16 to turn it on as diagrammed in FIG. 2. Displacement of the piston rod 94 to its armed position moves its reduced diameter portion 101 into underlying relations to a lock-out pin 102 which is thereby released for axial displacement by a spring 103 as shown in FIG. 6. The large diameter end portion 105 of the lock-out pin 102 is then moved by spring 103 to a position locking the piston rod 94 in its armed position following dissipation of momentary hydrodynamic pressure exerted on piston 80. A rotor 104 is also released by the piston rod 94 so that it may begin to turn under the torque applied thereto by the energy storing spring 70 through arbor 72 and the gearing of the time delay mechanism 36.

The gearing of the time delay drive mechanism 36 as depicted in FIG. 7 includes an input gear train 106 of increasing drive ratio connecting the low speed arbor 72 to a high speed dynamically unbalanced coupler gear 108 which is limited to a maximum rotational speed to provide the desired arming time. The gearing of the time delay mechanism 36 also includes an output gear train 110 of decreasing drive ratio connecting high speed coupler gear 108 to a low speed output gear 112 which angularly displaces the rotor 104 from a safe position to a position bringing a detonator 114 carried therein into alignment with lead 116 of the explosive train 28. The detonator 114 is thereby actuated to safely complete an explosive path to a bomb warhead 117 as diagrammed in FIG. 2, through a booster pellet 18 as shown in FIG. 3.

The safe-enable mechanism 42 hereinbefore referred to in connection with FIG. 2, includes a safety pin 120 which locks the piston 40 in its position engaging the rotor 104 and extending therefrom externally of the device 10, as shown in FIG. 1, to signify that the rotor 104 is in its safe position physically holding the detonator 114 electrically shorted in its out-of-line relationship to the leads 116. Also, a red portion of the lanyard 24 located inside of the safety section 18 of device 10 denotes that it is in its "safe" condition. The red portion of the lanyard therefore becomes visible only after sufficient lanyard payout occurs causing rupture of the shear pin 66 as hereinbefore described. Finally, a knob 122 is provided as part of the safe-enable mechanism externally mounted on housing 50 of device 10 as shown in FIG. 1, to signify that the hydrodynamic impact detecting piston 80 is in its safe position.

Obviously, other modifications and variations of the present invention may be possible in light of the foregoing teachings. It is therefore to be understood that within the scope of the appended claims the invention may be practiced otherwise than as specifically described.

What is claimed is:

1. A safety arming system adapted to be installed within a delivery envelope together with an explosive device detonated in response to a firing signal from a target detector, said system comprising: means responsive to deployment of said delivery envelope for establishment of an armed condition therein; explosive path means operatively connected to the target detector for conducting said firing signal only in said armed condition to the explosive device; and environmental means responsive to detection of a high velocity of the delivery envelop during water travel for maintenance of a safe condition during which said establishment of the armed condition is prevented.

2. A system for deployment of an underwater mine from an aircraft, including a lanyard connected to the aircraft, means for controlling payout of the lanyard from the aircraft, and explosive means associated with the underwater mine for detonation in response to a firing signal from a target detector after said payout of the lanyard, the improvement residing in means operatively connecting the lanyard to the explosive means for establishment of an armed condition during which said detonation occurs; water impact means for detection of water travel of the mine above a predetermined velocity; safe conditioning means for preventing said establishment of the armed condition until said detection of the water travel by the water impact means, a spool on which the lanyard is retained wound within the mine; and spring means connected to the spool for energy storage in response to payout of the lanyard from the spool during said deployment of the mine.

3. A safety arming system adapted to be installed within a delivery envelope together with an explosive device detonated in response to a firing signal from a target detector, said system comprising: means responsive to deployment of said delivery envelope for establishment of an armed condition therein; explosive path means operatively connected to the target detector for conducting said firing signal only in said armed condition to the explosive device; and environmental responsive means operatively connected to the explosive path means for maintenance of a safe condition during which said establishment of the armed condition is prevented said deployment responsive means comprising: a lanyard; a spool on which the lanyard is retained wound within the delivery envelope; and spring means connected to the spool for energy storage in response to payout of the lanyard from the spool during said deployment of the delivery envelope.

4. The system as defined in claim 3, including drive means connecting the deployment responsive means to the explosive path means for delaying said establishment of the armed condition.

5. The system as defined in claim 4 wherein said drive means comprises time delay gearing drivingly connecting the energy storage means to the explosive path means.

6. The system as defined in claim 5 wherein said explosive path means includes: a detonator and shorting means driven by said drive means for displacement of the detonator to a position establishing said armed condition.

7. The system as defined in claim 6 wherein said environmental responsive means includes: a piston engageable with the shorting means; fluid passage means exposing the piston to hydrodynamic pressure during said deployment for movement of the piston; and enabling control means for sequentially limiting said movement of the piston during performance of said energy storage by the spring means in response to payout of the lanyard followed by release of the spring means and release of the shorting means to permit said displacement of the detonator in response to continued movement of the piston.

8. The system as defined in claim 3 wherein said environmental responsive means includes: a piston; fluid passage means exposing the piston to hydrodynamic pressure during said deployment for movement of the piston; and enabling control means for limiting said movement of the piston during performance of said energy storage by the spring means in response to payout of the lanyard followed by release of the spring means.

9. A safety and arming system adapted to be installed within a delivery envelope together with an explosive device detonated in response to a firing signal from a target detector, said system comprising: means responsive to deployment of said delivery envelope for establishment of an armed condition therein; a detonator; displacement means for displacing the detonator to a position establishing said armed condition upon release from constraint; a piston engageable with the displacement means; fluid passage means exposing the piston to hydrodynamic pressure generated during water travel of the delivery envelope at a high velocity for movement of the piston; and enabling control means for limiting said movement of the piston followed by said release of the displacement means to permit said displacing of the detonator.

10. The system as defined in claim 9, including drive means connecting the deployment responsive means to the displacement means for delaying said establishment of the armed condition.

11. A safety arming system adapted to be installed within a delivery envelope together with an explosive device detonated in response to a firing signal from a target detector, said system comprising: means responsive to deployment of said delivery envelope for establishment of an armed condition therein; a detonator; displacement means for displacing the detonator to a position establishing said armed condition upon release from constraint; a piston engageable with the displacement means; fluid passage means exposing the piston to hydrodynamic pressure during said deployment for movement of the piston; and enabling control means for limiting said movement of the piston during said deployment of the delivery envelope followed by said release of the displacement means to permit said displacing of the detonator, and drive means connecting the deployment responsive means to the displacement means for delaying said establishment of the armed condition, said deployment responsive means comprising: a lanyard; a spool on which the lanyard is retained wound within the delivery envelope; and spring means connected to the spool for energy storage in response to payout of the lanyard from the spool during said deployment of the delivery envelope.

12. A system for deployment of an underwater mine from an aircraft, including a lanyard connected to the aircraft, means for controlling payout of the lanyard from the aircraft, and explosive means associated with the underwater mine for detonation in response to a firing signal from a target detector after said payout of the lanyard, the improvement residing in; means operatively connecting the lanyard to the explosive means for establishment of an armed condition during which said detonation occurs; water impact means for detection of water travel of the mine above a predetermined velocity; and safe conditioning means for preventing said establishment of the armed condition until said detection of the water travel by the water impact means.

* * * * *